United States Patent [19]

Otuka et al.

[11] Patent Number: 4,576,149

[45] Date of Patent: Mar. 18, 1986

[54] MASSAGER

[75] Inventors: Shinpei Otuka, Hikone; Kozo Kawai, Hirakata; Toshio Kusunoki, Hikone, all of Japan

[73] Assignee: Matsushita Electric Works, Ltd., Osaka, Japan

[21] Appl. No.: 626,384

[22] Filed: Jun. 29, 1984

[30] Foreign Application Priority Data

Jul. 20, 1983 [JP] Japan ..... 58-132200

[51] Int. Cl.[4] ..... A61H 1/00; A47C 7/62

[52] U.S. Cl. ..... 128/33; 128/44; 297/217

[58] Field of Search ..... 128/33, 44, 57; 297/346, 217

[56] References Cited

U.S. PATENT DOCUMENTS

| | | | |
|---|---|---|---|
| 3,640,272 | 2/1972 | Hussey | 128/33 |
| 3,800,785 | 4/1974 | Inada | 128/57 |
| 4,016,872 | 4/1977 | Yamamura | 128/57 |
| 4,230,098 | 10/1980 | Uematsu | 128/57 |
| 4,422,448 | 12/1983 | Sugai | 128/44 |
| 4,422,449 | 12/1983 | Hamabe | 128/44 |
| 4,434,468 | 2/1984 | Caddick | 297/346 |

FOREIGN PATENT DOCUMENTS 2091744 1/1982 United Kingdom .

*Primary Examiner*—Clyde I. Coughenour

*Attorney, Agent, or Firm*—Burns, Doane, Swecker & Mathis

[57] ABSTRACT

A massager for massaging user's body with a pair of massaging elements pressed thereto, which comprises a main shaft carrying the massaging elements operatively with the shaft, a driving shaft shiftable vertically with respect to the axis with rotatable means carried at both ends for driving the main shaft and massaging elements, and means for controlling movements of the massaging elements in both directions of the main shaft axis and perpendicular thereto and rendering the movements to be startable always from a predetermined position, that is, from the inner side to the outer side of the user's shoulders or from his shoulder side on the back towards his waist, whereby the massaging elements can start from an optimum position for an intended massaging effect, ensuring an excellent convenience of use and a highly effective massaging operation.

3 Claims, 18 Drawing Figures

MASSAGER

TECHNICAL BACKGROUND OF THE INVENTION

This invention relates to massagers and, more specifically, to the one which presses any desired part of the user's body with a pair of massaging elements variably at a strong or weak force, the elements being arranged to be shiftable integrally along the body and respectively towards or away from each other.

Generally, there have been suggested massagers which can move the massaging elements along the user's body for providing a massaging operation over a wide range expanding from the neck to the waist. As different users have different body figures or sizes, however, it has been demanded that the operational range of the massaging elements is made properly variable for adaption substantially to all users. In this connection, it has been known to be effective for promoting blood circulation to shift the massaging elements along blood flow in the human body, i.e., from the inner side to the outer side of shoulders or from the shoulder side to the waist side, so that the massaging effect can be enhanced to a large extent. Further, there are many right points especially effective for pressing massage operation in the back of body and thus a provision of a massager that can freely shift the massaging elements to any desired body point has been a keen demand.

DISCLOSURE OF PRIOR ART

A massager capable of varying the position of massaging elements has been suggested in, for example, British Pat. No. 2,091,744, in which a pair of the massaging elements are provided to be automatically variable in their mutual spacing and shiftable in directions perpendicular to their variably spaced direction, during a variety of massaging operations. In this massager, the massaging elements are automatically shiftable but, when a newly selected massaging operation is started after completion of another operation previously performed, the massaging elements have to start to operate at a position where the previous operation has been terminated so that, when the user desires to have the new operation started from the inner side to the outer side of his shoulders or from the shoulder side to the waist side of his back but the elements are not at such desired position, the user must manually cause the massaging elements moved to the desired position at each time of starting the new operation, and in this respect the known massager has been troublesome in its handling. In other words, the known device has urged the user to start any selected massaging at a random position of his body due to this troublesome handling and has been still unable to provide a sufficiently effective massaging in practice.

TECHNICAL FIELD OF THE INVENTION

A primary object of the present invention is, therefore, to provide a massager in which the position shift and halt of massaging elements with respect to the user's body are freely or, if required, automatically controllably performable in accordance with a predetermined program, allowing any selected massaging operation to be started with the massaging elements located at an optimum position for the particular operation, i.e., from the inner side to the outer side of the user's shoulders or from the shoulder side of his back gradually to the waist side, so as to realize sufficiently effective massaging operation with a high convenience in the handling.

This object of the present invention is attained by obtaining a massager which comprises generally means for urging a pair of massaging elements against the user's body to press and massage the same, means for relatively moving the massaging elements towards or away from each other, means for shifting the massaging elements in directions perpendicular to the relative moving direction of the elements, i.e., along the user's body, and means for controlling the shifting of the massaging elements and their massage start position.

Other objects and advantages of the present invention shall become clear from the following description of the invention detailed with reference to preferred embodiments illustrated in accompanying drawings.

Figure 1:
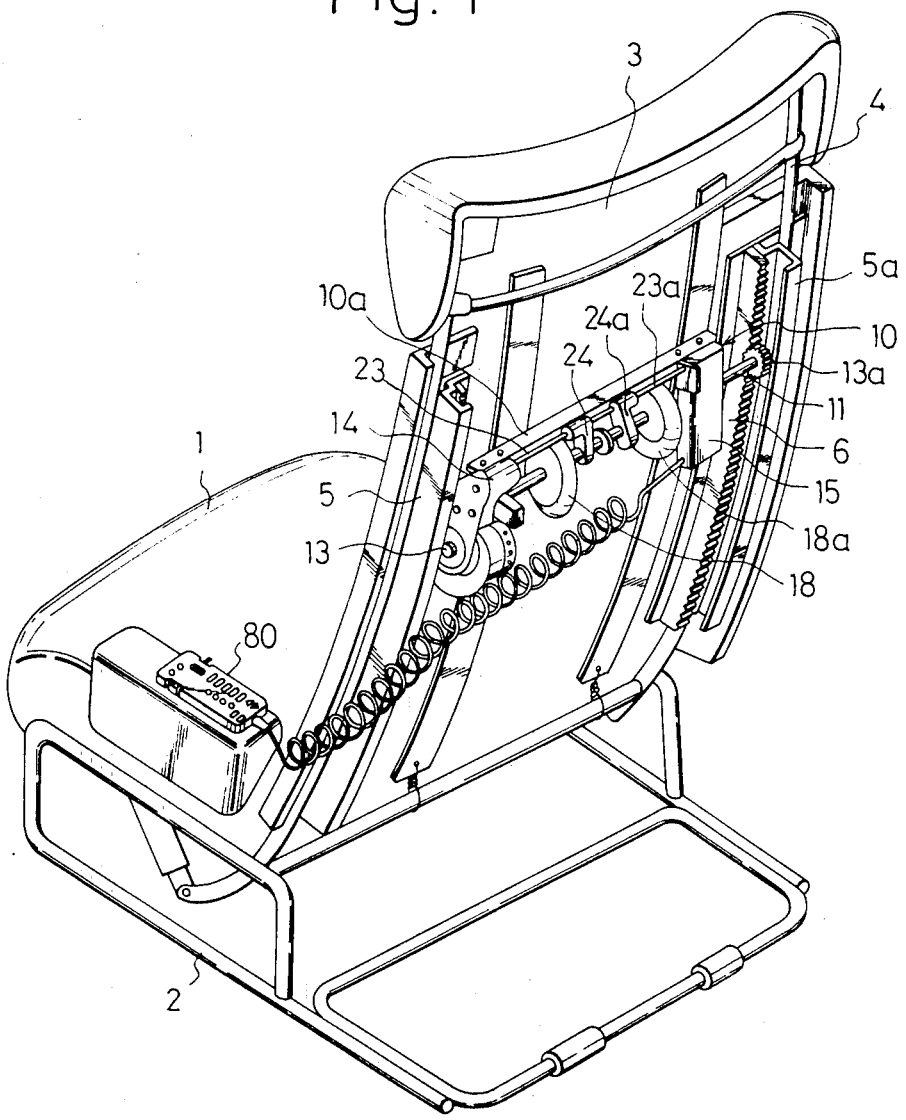
FIG. 1 is a perspective view as seen from the back side of the massager in an aspect of the present invention applied to a chair.

While the present invention shall now be described with reference to the preferred embodiments shown in the drawings, it should be understood that the invention is not to limit the invention only to the particular embodiments shown but rather to cover all alterations, modifications and equivalent arrangements possible within the scope of appended claims.

DISCLOSURE OF PREFERRED EMBODIMENT

Figure 2:
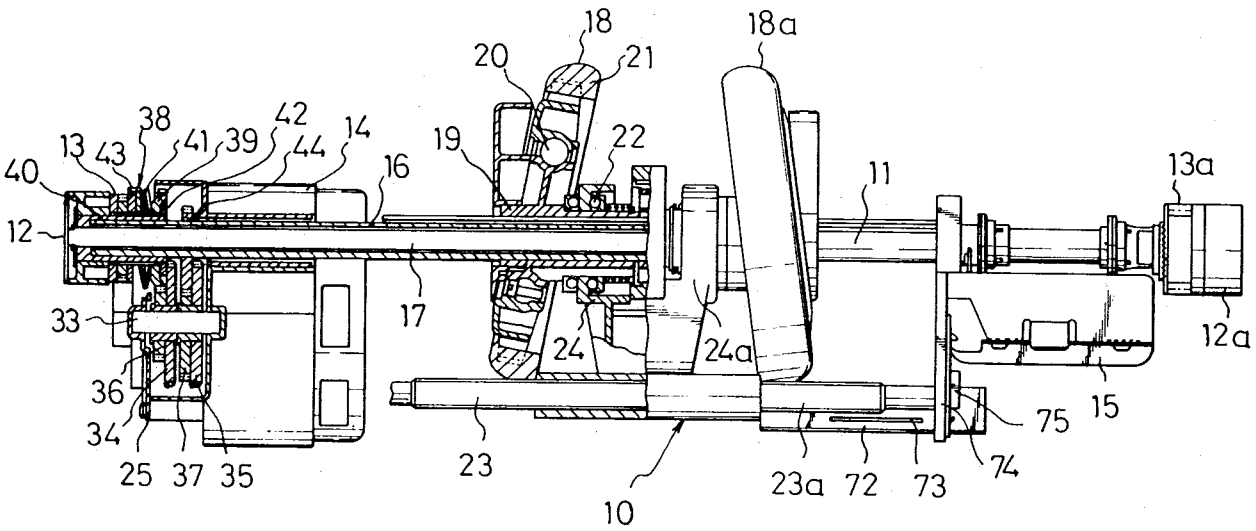
FIG. 2 is a top plan view shown partly in section of the massager of FIG. 1 as disassembled from the chair.
Figure 3:
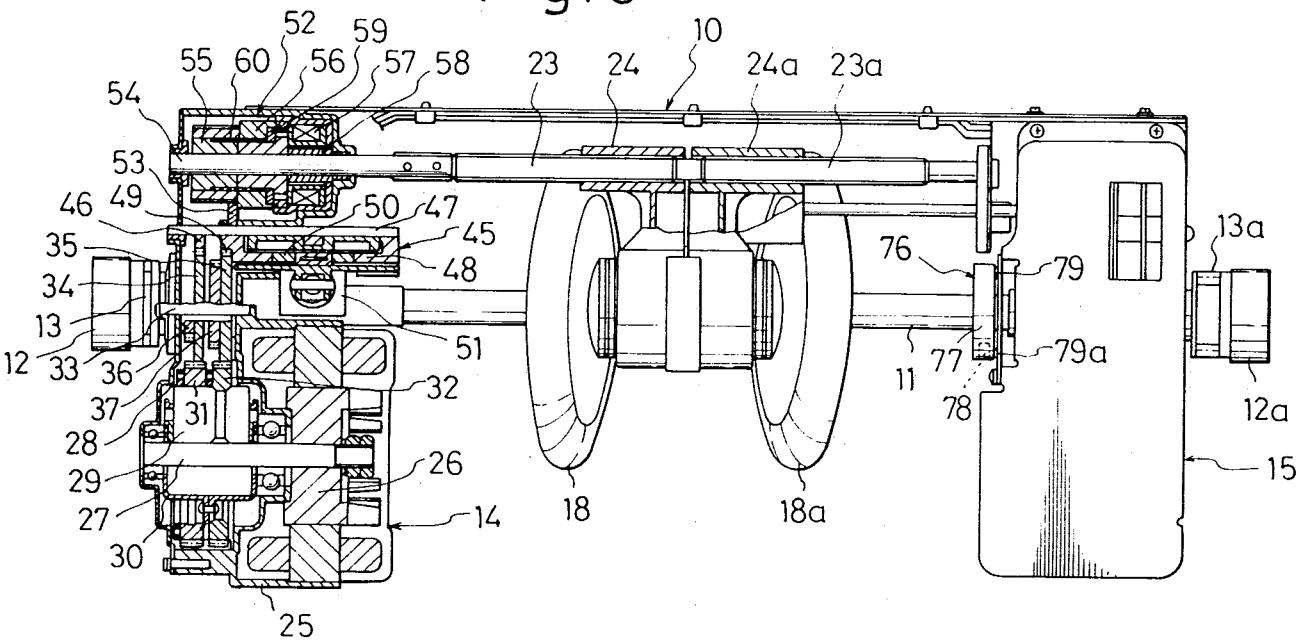
FIG. 3 is a rear side elevation of the massager in FIG. 2 with a gear box shown in section as partly cut or removed.

Referring especially to FIGS. 1 to 3, in the illustrated embodiment, a massager 10 according to the present invention is assembled, in the illustrated embodiment, with a chair 1 having legs 2 and backrest 3, specifically on the rear side of the backrest 3. In the present instance, a backrest frame 4 integral with the legs 2 as made respectively of a tubular member is fixedly provided with a pair of parallel guide rails 5 and 5*a* having a U-shaped section, of which open grooves are opposed to each other substantially vertically, and a rack 6 is provided adjacent each of the opposed openings of the guide rails 5 and 5*a*. A shaft means 11 of the massager 10, on the other hand, is provided at its both axial ends with rolls 12 and 12*a* rotatably projecting into the open grooves of the guide rails 5 and 5*a* and, immediately inside the rolls, with pinions 13 and 13*a* which mesh with the racks 6 so that, when the shaft means 11 as well as the pinions 13 and 13*a* rotate, the massager 10 will shift upward or downward along the guide rails 5 and 5*a* as thereby guided through the rolls 12 and 12*a* on the rear side of the chair 1.

The massager 10 further comprises a gear box 14 disposed on one axial end side and a control box 15 disposed on the other axial end side of the shaft means, the boxes being secured to respective opposing end portions of a coupling plate 10*a*. The shaft means 11 is journalled across the both boxes 14 and 15 and extends out of them, at the extended ends of which the rolls and pinions 12, 13 and 12*a*, 13*a* are respectively mounted.

The shaft means 11 also comprises a main shaft 16 made of a tubular member in the present instance and a driving shaft 17 inserted coaxially in the main shaft, and a pair of massaging elements 18 and 18*a* substantially of a disk shape are mounted to the outer main shaft 16 respectively at a diagonally angled relation to the axis of the main shaft and mutually in a symmetrical relation to each other with respect to the center of the main shaft. The pair of massaging elements are spline-connected to the peripheral surface of the main shaft so as to be both rotatable together with the main shaft 16 in its circumferential directions and shiftable mutually in opposite axial directions. More specifically, each of the massaging elements 18 and 18*a* comprises an inner wheel 19 made eccentric to the main shaft and an outer wheel 21 freely rotatably mounted through a ball bearing 20 to the circumferential periphery of the eccentric inner wheel 19. It is preferable that the outer wheel 21 comprises inner and outer peripheral portions joined by radial ribs, and that an elastic ring member of rubber or the like material is fitted to the outer peripheral surface of the outer wheel 21. The eccentric inner wheel 19 is coupled through a thrust bearing 22 to an end of one of connecting arms 24 and 24*a* which are supported by a feed screw rod having on the periphery a pair of screw threads 23 and 23*a* of opposite threaded directions, at each of which threads 23 ahd 23*a* the rod is inserted through threaded holes in the other end of the arm 24 or 24*a*. This rod having the screw threads 23 and 23*a* is journalled between the boxes 14 and 15 in parallel relation to the shaft means 11, so as to provide opposite directional feeding rotations to the arms 24 and 24*a* for shifting them axially in opposite directions together with the massaging elements 18 and 18*a*.

The gear box 14 provides a driving force to the shaft means 11 and feed screw rod having the threads 23 and 23*a* and, as seen in FIG. 3, a gear box casing 25 contains a reversible motor 26 an output shaft 27 of which is coupled to a planetary mechanism 28 also contained in the casing. This mechanism 28 comprises a retainer 30 which forms a planet carrier for holding rollers 29 (only one of which is illustrated but, for example, three of them are arranged around the periphery of the output shaft 27 at every rotary angle of 120 degrees) rollable in contact with the output shaft 27 and respectively formed to have a circumferential groove in their periphery. Each of the rollers 29 engages at the periphery with the inner surface of a first ring-shaped gear 31 and at the circumferential groove with the inner surface of a second ring-shaped gear 32 so that the first and second gears 31 and 32 can rotate with the rolling of the rollers 29. The outer peripheral teeth of the first and second gears 31 and 32 mesh with transmission gears 34 and 35 carried on a supporting shaft 33, and the gear 34 meshing with the first gear 31 has an integrally formed transmission pinion 36 whereas the gear 35 meshing with the second gear 32 has an integral elliptic gear 37.

As seen in FIG. 2 next, the transmission pinion 36 meshes with a clutch gear 39 in a clutch 38 functioning as a torque limiter, and this clutch gear 39 is loosely fitted around a transmission cylinder member 40 and normally biased into engagement with a driven flange 42 by means of a pair of opposed saucer springs 41. As the driven flange 42 is secured to an inner end of the transmission cylinder 40 which itself is coupled at the other outer end to the driving shaft 17 while the roll 12 and pinion 13 are secured onto the cyliner 40, a driving force of the motor 26 (FIG. 3) is transmitted to the driving shaft 17 through a reduction gear train formed by the rollers 29, first ring-shaped gear 31, transmission gear 34, transmission pinion 36 and clutch gear 39 and through the driven flange 42 and cylinder 40 of the clutch 38, and the rolls 12, 12*a* and pinions 13, 13*a* rotate together with the driving shaft 17. When a load exceeding the biasing force of the springs 41 in the clutch 38 is applied to this drive force transmission system, the clutch gear 39 is separated from the driven flange 42 to prevent the driving force of the motor 26 from being transmitted to the driving shaft 17. In the present instance, further, the driving force transmission may be controlled by means of a releasing plate 43 insertable into the clutch for establishing the biasing force of the springs 41 and retreatable from the clutch for releasing the biasing force with an external operating force.

On the other hand, the elliptic gear 37 operatively coupled to the second ring-shaped gear 32 meshes with an elliptic gear 44 secured to the main shaft 16 and the rotational driving force of the motor 26 is transmitted through a reduction gear train of the rollers 29, second ring-shaped gear 32, transmission gear 35 and elliptic gears 37 and 44 to the main shaft 16 carrying the massaging elements 18 and 18*a* to rotate them in such manner that, when the eccentric amount of the massaging elements 18 and 18*a* being rotated with the shaft 16 becomes the largest with respect to the axis of the shaft 16 to be projected towards the user's body to the largest extent depending on the meshing position between the both elliptic gears 37 and 44, and the main shaft 16 is axially rotated at a reduced rate but with an increased torque.

Turning again to FIG. 3, there is provided further in the gear box 14 a braking mechanism 45 which selectively controls the transmission of rotating force of either one of the first and second ring-shaped gear 31 and 32. The braking mechanism does not form a major feature of the present invention (in FIG. 3, there are shown the least number of members enough for clarifying operational correlation between respective constituent members in the braking mechanism and as partly omitted for showing an electromagnetic clutch mechanism to be described later) and will be briefly explained. The braking mechanism 45 comprises a first control system 48 including a pinion 46 which meshes with the transmission gear 34 operatively coupled to the first ring-shaped gear 31 and an interlocking shaft 47 to which the pinion 46 is fixed, and a second control system 50 including a gear part 49 meshing with the transmission gear 35 operatively coupled to the second ring-shaped gear 32. The braking mechanism 45 also includes a solenoid 51 which can drive an actuating rod (not shown) subjected to a return biasing spring force so that, when the solenoid 51 is excited, the first control system 48 is released through, for example, the actuating rod but the second control system 50 is restrained to allow the driving shaft 17 to be rotated whereas, when the solenoid 51 is not excited and the actuating rod is return biased, the second driving system 50 is released but the first braking system 48 is restrained to allow the main shaft 16 to be rotated.

The gear box 14 further includes an electromagnetic clutch mechanism 52 which selectively controls the transmission of rotating force to the feed screw rod having the screws 23 and 23*a*. This clutch mechanism 52 comprises a reduction gear 53 meshing with the transmission gear 35 operatively coupled to the second ring-shaped gear 32, and an input part 55 meshing with the reduction gear 53 and loosely receiving a feed shaft 54 connected to an end of the feed rod on the side of the feed screw 23. Further, the feed shaft 54 fixedly secures an output part 56 and carries as loosely mounted thereon an electromagnetic device 57 on the side opposite to the input part 55, with the output part 56 interposed between the members 55 and 57. The electromagnetic device 57, when excited, is attracted on one hand to the feed shaft 54 through a cylindrical iron core 58 and on the other hand attracts a clutch shoe 59 which is connected to the input part 55 through springs 60 penetrating through the output part 56, whereby the input part 55 and clutch shoe 59 are joined to the output part 56 and the rotary driving force is transmitted through the reduction gear 53 and shaft 54 to the feed rod.

Figure 4:
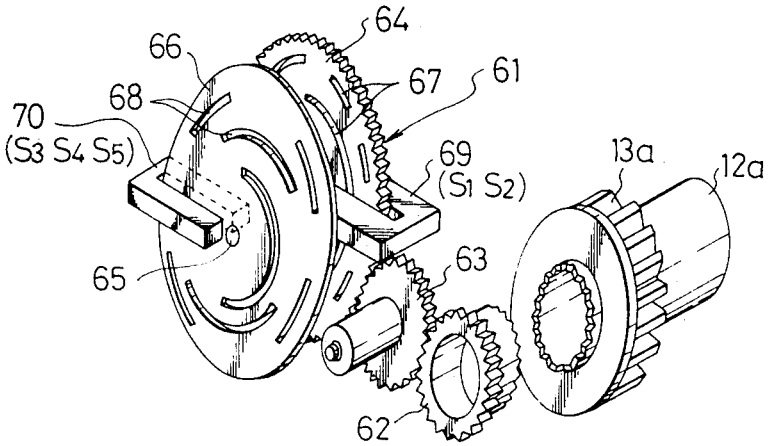
FIGS. 4 and 5 are perspective views as magnified of a sensor part and another associated part, respectively, of the massager in FIG. 2.

The massager according to the present invention is further provided with means for detecting various positions of the massaging elements 18 and 18*a*, including thus a vertical position detector 61, a width detector 71 and a projection detector 76. The vertical position detector 61 is disposed within the control box 15 and comprises, as shown in FIG. 4, an input gear 62 loosely mounted on the main shaft 16 and meshable with clutch-gear teeth formed on the inner surface of the pinion 13*a* at the other end of the shaft means 11 than the end to which the gear box 14 is coupled, a gear wheel 64 operatively connected through an intermediate gear 63 to the input gear 62, and a disc 66 having substantially the same size as the gear wheel 64 and opposed thereto through a shaft 65. The gear wheel 64 and disc 66 are respectively provided with a plurality of coaxial arcuate slits 67 or 68 which are made in the wheel or disc at its radially and circumferentially different positions. Sensor holders 69 and 70 of a U-shape are provided so as to interpose between their both extended legs respectively each of the wheel 64 and disc 66, and the holders are respectively provided with sensors each comprising light emitting and receiving elements in the legs to oppose each other.

In the illustrated embodiment, the gear wheel 64 is formed to have the arcuate slits 67 disposed along two circle lines of different radii and the sensor holder 69 contains two sensors S1 and S2, whereas the disc 66 is formed to have the arcuate slits 68 along three circle lines of different radii and the sensor holder 70 contains three sensors S3, S4 and S5. In this case, the respective sensors can be operated when the arcuate slits 67 and 68 are positioned between the light emitting and receiving elements of the respective sensors. More particularly, the sensors S1 and S2 of the holder 69 operate respectively in response to the arcuate slits in the wheel 64 along the radially outer circle line and those along the radially inner circle line. Similarly, the sensors S3 to S5 of the holder 70 operate respectively in response to the arcuate slits in the disc 66 along the radially outermost circumferential circle line, those along the radially intermediate circumferential circle line and those along the radially innermost circle line.

Figure 5:
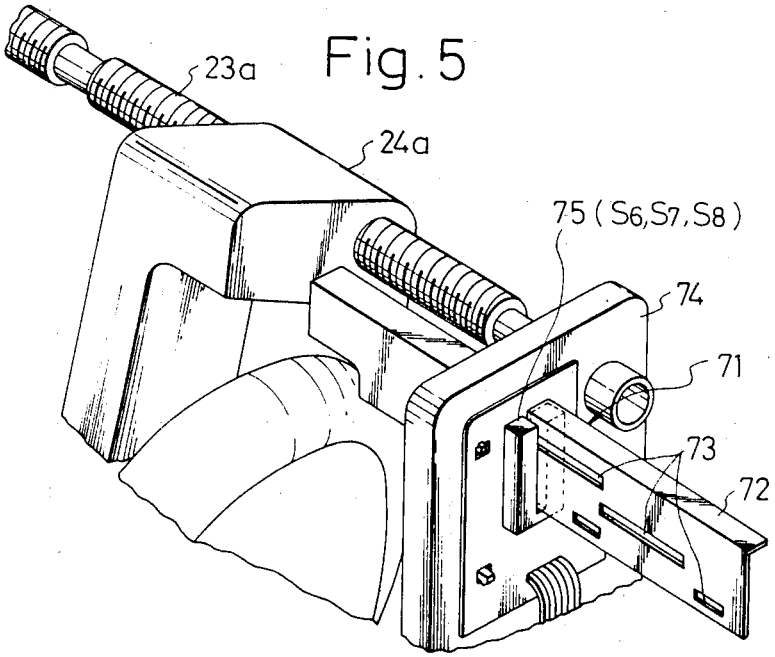

Referring next to FIG. 5, the width detector 71 comprises a detecting plate 72 secured at its one end to the arm 24*a* coupled to the massaging element 18*a* and having a plurality of slits 73 longitudinally extending at different positions in widthwise and lengthwise directions, the plate being extended slidably through a supporting plate 74 provided to project from the control box 15, and a U-shaped sensor holder 75 secured to the supporting plate 74 to interpose between both extended legs the detecting plate 72, the holder having in the legs a plurality of sensors each comprising light emitting and receiving elements opposed to each other. In this embodiment, the slits 73 in the detecting plate 72 are made to extend along three straight lines and the sensor holder 75 contains three sensors S6, S7 and S8 at positions corresponding to these three lined slits.

Figure 6:
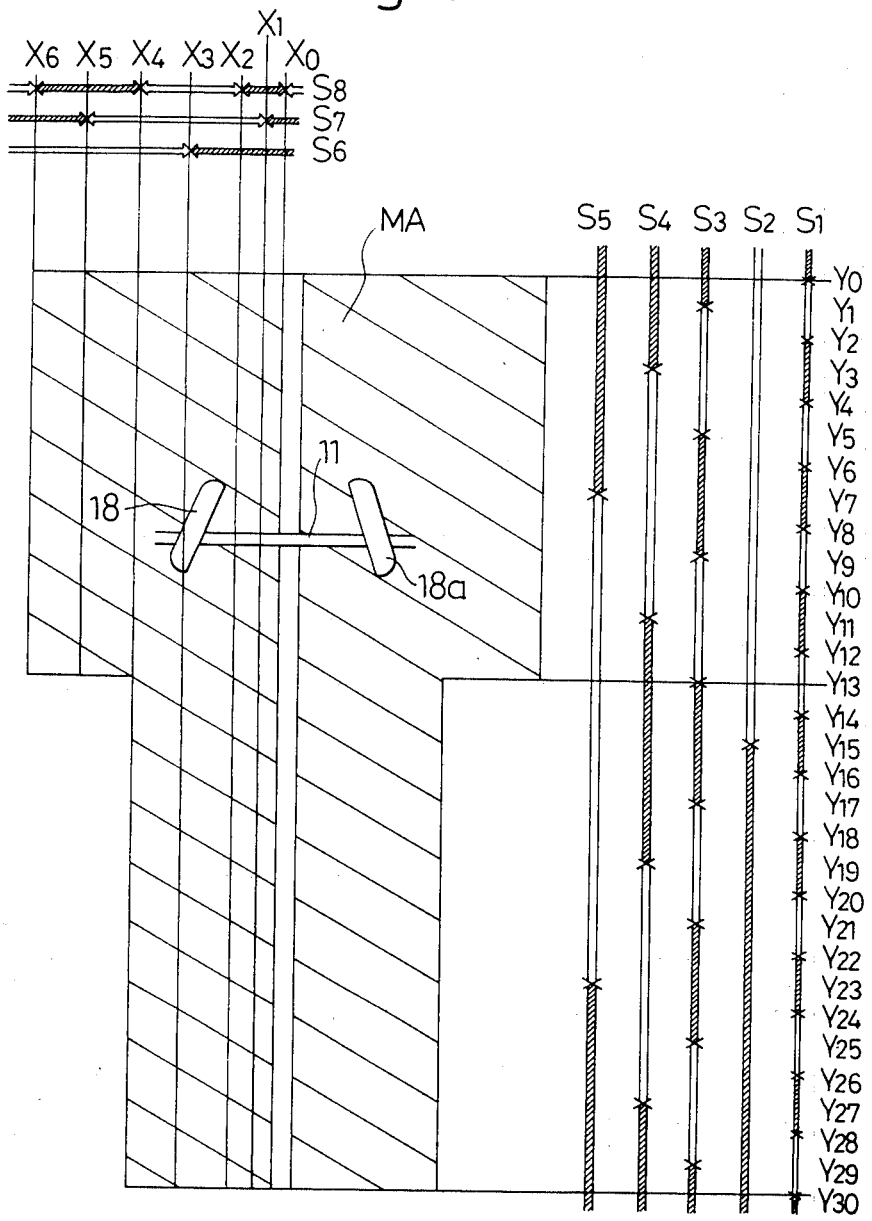
FIG. 6 is a diagram showing a detection pattern by means of the sensor shown in FIGS. 4 and 5 of the massager.

Referring more specifically to the vertical position detector 61, the slits 67 and 68 in the gear wheel 64 and disc 66 are provided preferably according to such a pattern as shown in FIG. 6, which is designed so that the sensors S1 to S5 can detect the rotational position of the shaft means 11 at 31 points denoted by Y0 to Y30 and eventually the position of the massaging elements 18 and 18*a* shifted upward or downward. For the width detector 71, the slits 73 in the detecting plate 72 are also provided in the pattern of FIG. 6 designed to allow the sensors S6 to S8 to detect moved positions of the massaging element 18*a* at 7 points denoted by X0 to X6 on the shaft means 11 and eventually the spacing between the both massaging elements. In the drawing, unhatched and hatched portions in each of double-lines for the respective sensors S1 to S8 indicate that the associated sensors S1 to S8 are turned ON and OFF, respectively, and a hatched zone MA indicates the optimum moving area of the massaging elements 18 and 18*a*. This area MA is made narrower at the lower part than the upper part so that the axial spacing of the both massaging elements is made smaller on the user's waist side than that on the shoulder side in order to avoid the pressing such body part that corresponds to the kidney or the like internal organ of which massaging is unfavourable.

The projection detector 76 is shown in FIG. 3 and comprises a rotation detecting disc 77 secured concentrically onto the main shaft 16 at a position close to the control box 15, a permanent magnet 78 attached to the rotation detecting disc 77 for rotation with the shaft and disc, and such magnetically responsive sensors 79 and 79*a* as reed switches attached to the control box 15 at positions where the respective sensors can face closely the permanent magnet 78 on the disc 77 when the magnet is disposed upon the largest and smallest projections of the massaging elements 18 and 18*a*, the sensor 76 being at the position for the largest projection and the other sensor 79*a* being for the smallest projection in the present instance.

Figure 7:
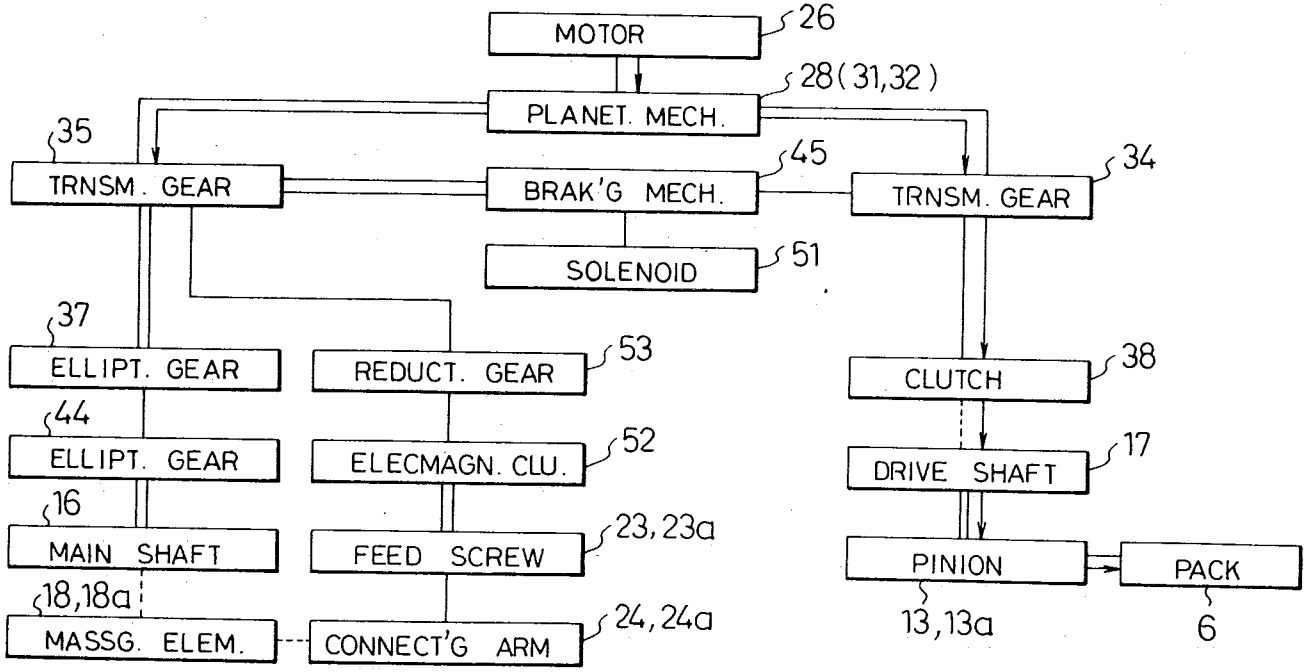
FIGS. 7, 7A and 7B are block diagrams of major constituent members of the massager in FIG. 2 for showing respective correlations between the members in different operational states.

The operation of the massager arranged as has been disclosed shall be explained with reference to FIGS. 7 to 7B, in which the respective blocks of the foregoing constituent members which are mutually fixedly coupled are shown as connected by double solid lines, those of the members mutually operatively coupled are connected by a single solid line, those of the members relatively shiftably coupled are connected by a broken line, and those of the members between which a force is transmitted are connected by an additional arrow denoting the transmitting direction. More specifically, there is shown in FIG. 7 how the massaging elements 18 and 18*a* are shifted up or down, in which the driving force of the motor 26 is transmitted through the first and second ring-shaped gears 31 and 32 of the planetary mechanism 28 to the transmission gears 34 and 35. In this case, the first braking system 48 of the braking mechanism 45 is released and the second control system 50 is restrained, and a differential rotating force corresponding to a difference in the diameter between the outer peripheral surface and the circumferential groove of the rollers 29 is transmitted through the clutch 38 to the driving shaft 17, whereby the rotation of the pinions 13 and 13*a* with the shaft thus rotated causes the rolls 12 and 12*a* to be guided along the guide rails 5 and 5*a* and the driving shaft 17 as well to be shifted upward or downward along the racks 6 according to the normal or reverse rotating direction of the motor 26. The upwardly or downwardly shifted position of the driving shaft 17 and of the massaging elements 18 and 18*a* is detected by the vertical position detector 61 sequentially at the 31 detecting positions of FIG. 6.

Figure 7A:
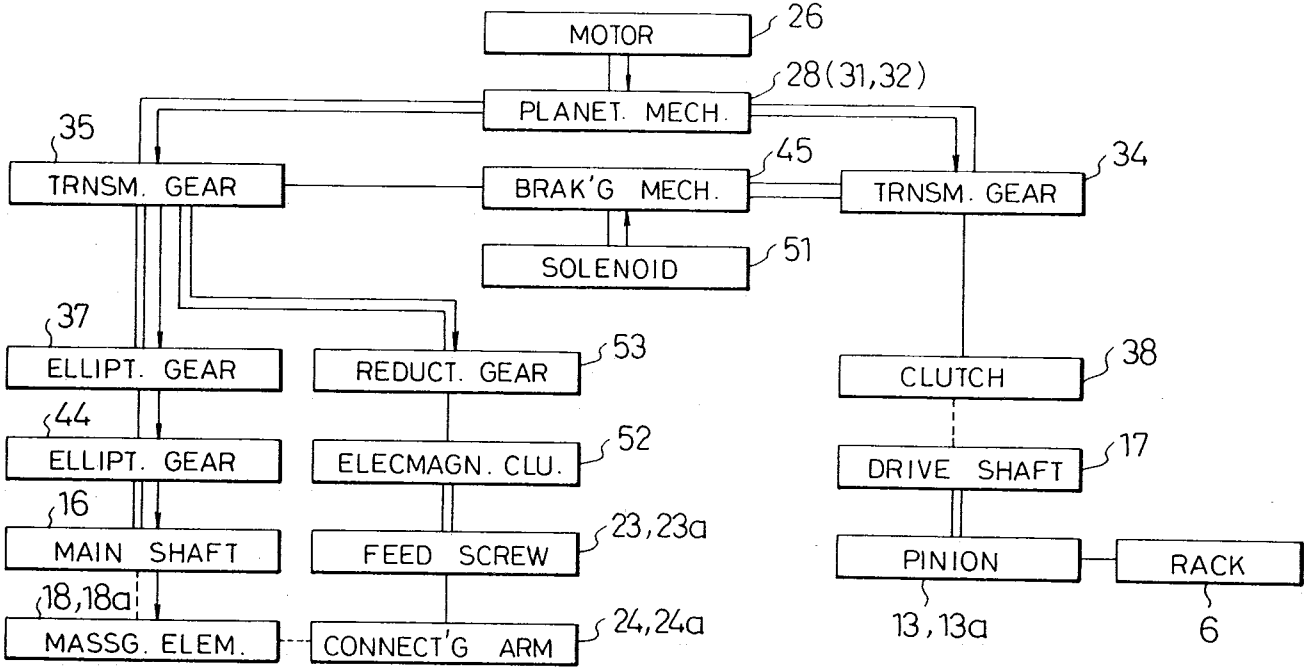

In FIG. 7A, there is shown how the massaging elements 18 and 18*a* themselves are rotated. The driving force of the motor 26 is transmitted through the planetary mechanism 28 to the transmission gears similarly to the foregoing vertical shifting but, in this case, the solenoid 51 is energized to restrain the first braking system 48 of the braking mechanism 45 and to release the braking system 50, whereby the differential rotating force corresponding to the diametral difference in diameter between the outer peripheral surface and the circumferential groove of the roller 29 is transmitted through the elliptic gears 37 and 44 to the main shaft 16. This rotating force transmission made through the set of elliptic gears causes that, when the projected amount of the massaging elements 18 and 18*a* eccentrically mounted on the main shaft, 16 becomes the largest, the elements are rotated at the lowest speed but with the maximum torque. The rotational state of the main shaft 16 is detected by the projection detector 76 at the two points and thus the projected amount of the massaging elements can be detected. Further, the main shaft 16 can be reversibly rotated according to the normal or reverse rotational direction of the motor 26, realizing a "massage down" operation to sequentially press the user's back from the shoulder side to the waist side with the massaging elements shifted in that direction, as well as a "massage up" operation in opposite direction with the elements so shifted.

Figure 7B:
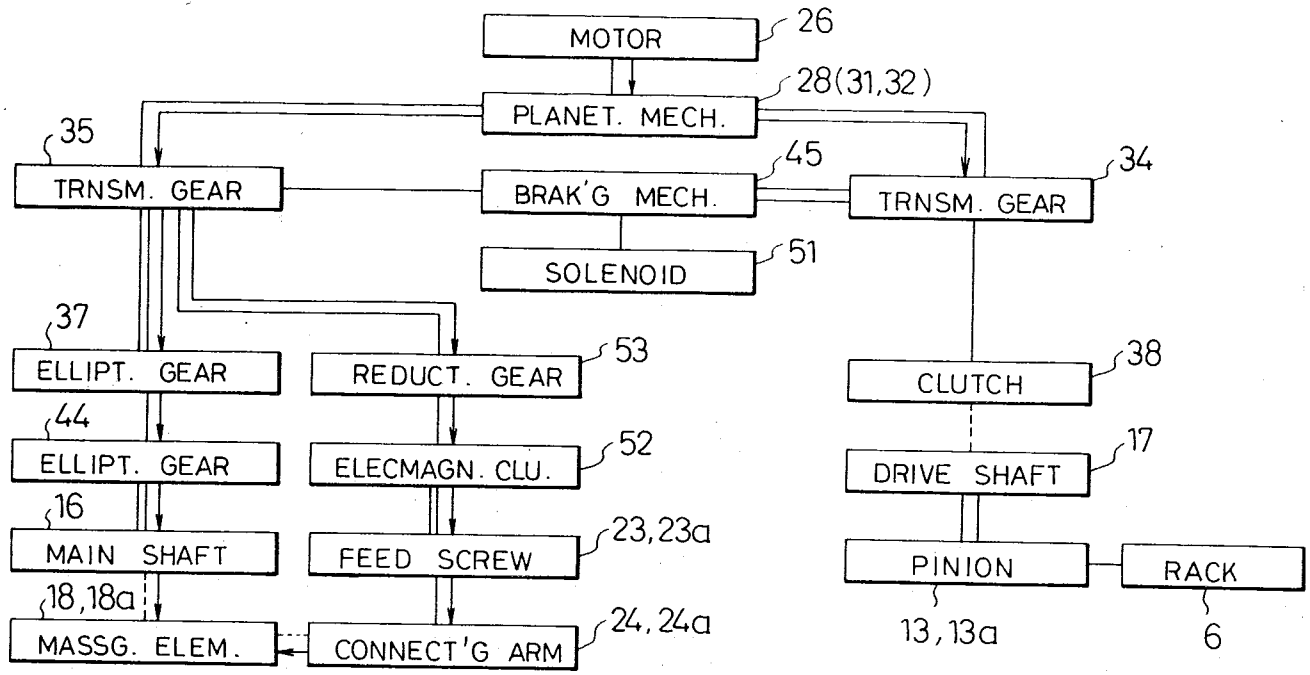

FIG. 7B shows how the spacing between the both massaging elements 18 and 18*a* is varied. In this case, the transmission of the rotary driving force for the shifting driving of these elements is substantially the same as that in FIG. 7A. For the space variation, the electromagnetic device 57 for the electromagnetic clutch 52 is also energized to couple the input part 55 to the output part 56 in the electromagnetic clutch 52, and the driving force given from the transmission gear 35 through the reduction gear 53 to the clutch 52 is transmitted to the feed screw having the screws 23 and 23*a* for their axial rotation, causing the both connecting arms 24 and 24*a* to shift toward or away from each other depending on the rotational direction of the motor 26, whereby the both massaging elements 18 and 18*a* coupled to these connecting arms 24 and 24*a* are correspondingly shifted toward or away from each other along the main shaft 16 to which the elements are spline-coupled. The spacing between the massaging elements 18 and 18*a* is detected by the width detector 71 sequentially at the 7 points X0 to X6 for detecting the axial shift of one of the elements.

According to the massager of the present invention, therefore, it is possible to realize various massage operations and effects with a pair of the massaging elements 18 and 18*a* which can shift vertically up or down through the actuation of the driving shaft 17, with or without own rotation of the element through actuation of the main shaft 16, and with or without the relative horizontal shifts of the both elements, thus including effective massage up and down operations in connection with the vertical shifts of the elements, and the vertical and horizontal shifts being capable of starting from the shoulder side and the inner shoulder side to the waist side and the outer shoulder side.

Figure 1A:
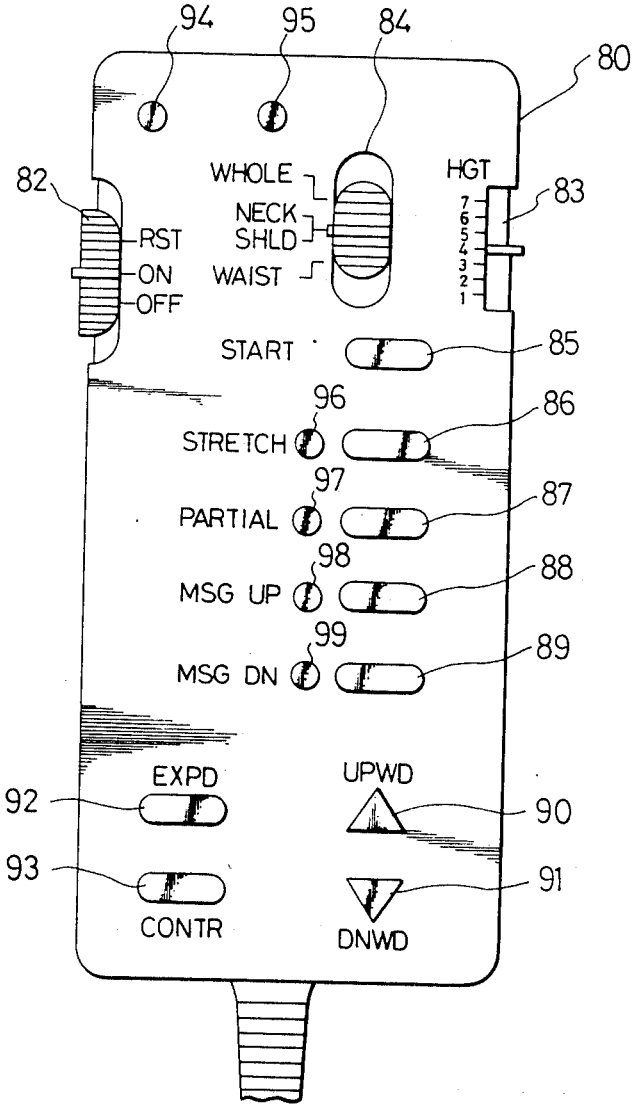
FIG. 1A is an enlarged plan view of a control switch box for use with the massager of FIG. 1.
Figure 8A:
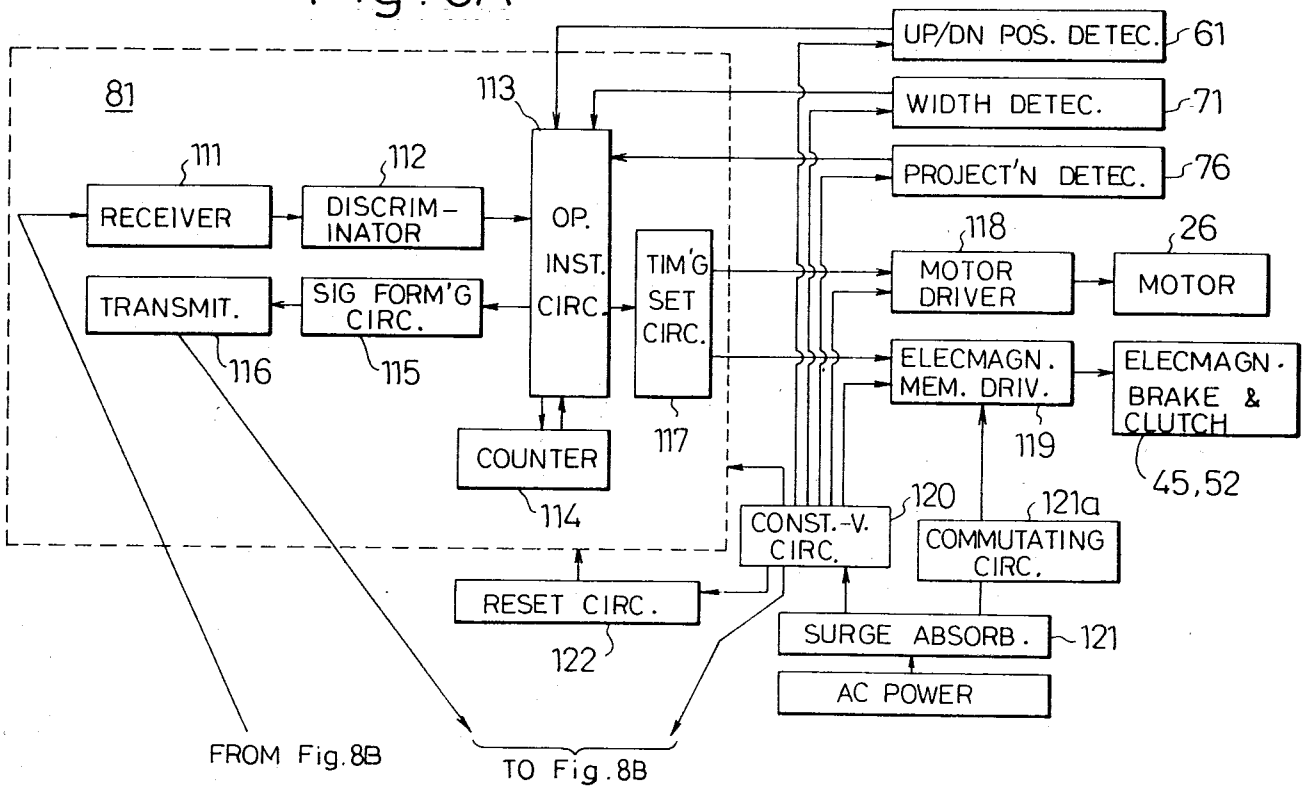
FIG. 8 is a block diagram of main and auxiliary control circuits with their associated constituent members of the massager of the present invention, which are shown as divided into FIGS. 8A and 8B to be joined as in FIG. 8C.
Figures 8B, 8C:
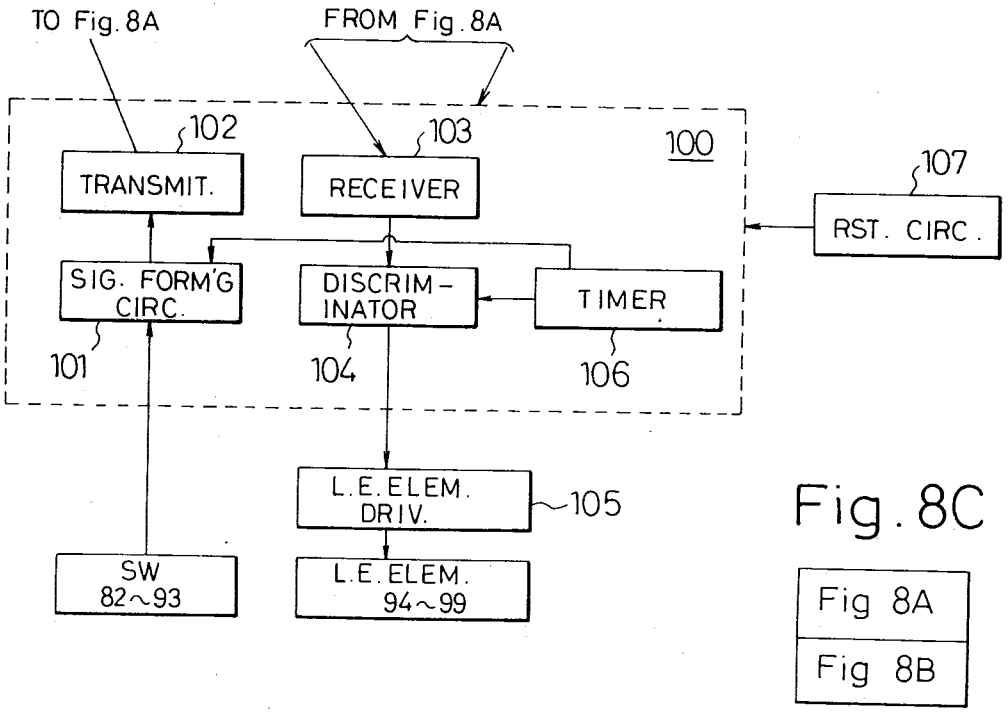

Referring further to FIGS. 1 and 1A as well as FIG. 8, according to the present invention, there is provided a control switch box 80 with which the user can appoint any one of the massaging operations. The box 80 is connected through extended cord to a main control circuit 81 comprising a microcomputer contained in the control box 15. The control switch box 80 comprises a total of 12 switches, including a mode switch 82 for selecting one of three modes of "RESET" for positioning the massaging elements 18 and 18*a* to be at the minimum projection and of "ON" and "OFF" of the massager; a height setting switch 83 for adapting the heightest position of the massaging elements to the user's own sitting height; a pattern switch 84 for selecting one of such massaging program patterns as "WHOLE", "NECK·SHOULDER" and "WAIST" pre-programmed in the main control circuit 81; a start switch 85 for starting the operation in accordance with the selected pattern; a switch 86 for causing the massaging elements to operate automatically reversably and continuously in the whole moving area MA as hatched in FIG. 6 and the upper limit of which is set by the height setting switch 83 and for realizing the stretching of the user's back; a partial operation switch 87 for specifying the massaging operation to restrict the operational range of the massaging elements to, for example, the upper portion only of the user's back; a switch 88 for performing the massage up operation; a switch 89 for performing the massage down operation; a switch 90 for shifting up the massaging elements during actuation of the back stretching switch 86; a switch 91 for shifting down the massaging elements during actuation of the switch 86; a switch 92 for expanding the spacing of the massaging elements being operated; and a switch 93 for contracting the spacing of the massaging elements being operated. Preferably, the light emitting elements 94 to 99 for indicating the respective operating states of the switches 82, 85 and 86 to 89 are provided to the control switch box.

Further, an auxiliary control circuit 100 is contained in the control switch box 80 in the form of a microcomputer in order to minimize the length of wirings between the main and auxiliary control circuits 81 and 100. In the auxiliary control circuit 100 in an embodiment of FIG. 8, the state of the respective switches 82 to 93 is converted to an electric signal through a signal forming circuit 102 and signal transmitter 102, and this signal is sent to the main control circuit 81. The auxiliary control circuit 100 further includes a circuit 103 for receiving a discrimination signal sent from the main control circuit 81, so that the discrimination signal is sent through a signal discriminator 104 and a light-emitting-element driver 105 to illuminate the light emitting elements 94 to 99. Further, a timer circuit 106 is connected to the signal forming circuit 101 and signal discriminator 104 so as to turn off the operation of the circuit 101 after a predetermined time period. A reset circuit 107 for properly resetting the auxiliary control circuit 100 is attached to the circuit 100.

On the other hand, the main control circuit 81 includes a circuit 111 for receiving the signal from the auxiliary control circuit 100 and applying the signal through a signal discriminator 112 to an operation instructing circuit 113. The operation instructing circuit 113 receives respective outputs of the signal discriminator 112, a counter circuit 114 counting the number of revolutions and vertical shifts of the massaging elements, the vertical up/down position detector 61, width detector 71 and projection detector 76, and sends a discrimination signal through a signal forming circuit 115 to a signal transmitter 116 to supply the signal to the signal receiving circuit 103 in the auxiliary control circuit 100. Another output of the instruction circuit 113 is supplied to a timing set circuit 117 which in turn sends outputs separately to a motor driver 118 and an electromagnetic member driver 119 to drive the motor 26 and energize the electromagnetic clutch 52 as required. To the main control circuit 81, a voltage is to be applied from a constant voltage circuit 120 which in turn is connected through a surge absorbing circuit 121 to an AC power source. Preferably, the main control circuit 81 is provided with a reset circuit 122 for properly resetting the circuit 81. As will be clear from FIG. 8, the constant voltage circuit 120 provides the electric power to the auxiliary control circuit 100 and reset circuit 122, and also to the up/down position detector 61, width detector 71, projection detector 76, motor driving circuit 118 and electromagnetic member driving circuit 119, to which circuit 119 on the other hand an AC power is also supplied from the AC power source through the surge absorbing circuit 121 and a rectifier circuit 121*a*.

Figure 9:
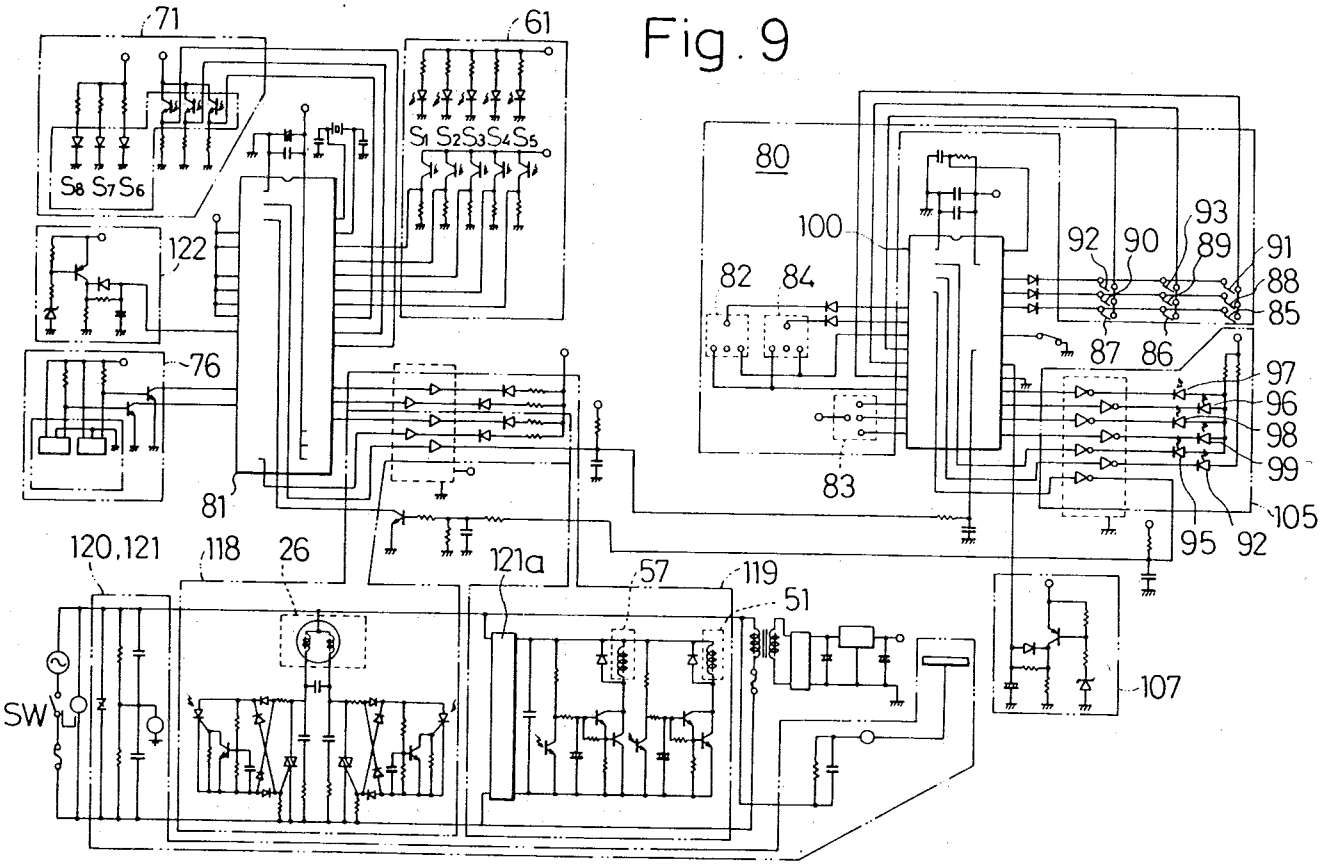
FIG. 9 is a practical circuit diagram in an embodiment of the control circuits of FIGS. 8A and 8B.

FIG. 9 is a detailed circuit diagram showing a practical example of the block diagram shown in FIG. 8, wherein parts corresponding to those in FIG. 8 are denoted by identical reference numerals.

Next, the operating procedure of the present invention shall be detailed. When it is desired to manually cause a massaging operation performed, without utilizing any programmed pattern of the control circuit, the mode switch 82 is shifted to its "ON" position and, if necessary, the switch 91 for downward shift of the massaging elements or the switch 90 for upward shift of them is also actuated to shift the massaging elements to a desired one of the points Y0 to Y31. During this shift, the massaging elements are controlled specifically by the projection detector 76 and main control circuit 81 so that the largest projected state of the elements will be maintained. Generally, it has been known to be effective that the massaging operation is performed downward on the shoulder side of the back but upward on the lower waist side, and one of such downward and upward massaging operations can be realized by operating the switch 88 or 89 as the case demands. In addition, when it is desired to increase or decrease the spacing between the massaging elements, the desired spacing can be obtained by operating the switch 92 or 93. Further, when the massaging elements have reached their extreme position of the point Y30, Y0, X6 or X0 through actuations of the switches 91, 92 or 92, 93, the entire operating system of the massager stops and, so long as these switches are turned off, any massaging operation can be realized even at the extreme position. When the massaging elements are shifted down beyond the point Y13, one massaging elements are prevented from shifting horizontally to expand beyond the point X4 (refer to FIG. 6).

When it is desired to perform a back stretching massage, a depression of the switch 86 will cause the pair of the massaging elements to be located at the point X0 providing the minimum spacing between the elements and to be set at the largest projected position, and the elements repeatedly shift up and down between two desired ones of the points Y0 to Y30 set by the height selecting switch 83. On the other hand, when the partial operation switch 87 is actuated, the massaging elements are set to have the minimum spacing and the largest projected position, and the elements repeatedly shift over such a limited extent as 4 points up and down from the set position. In this case, an alteration of the partial massaging zone can be realized by operating the switch 90 or 91.

In addition, when the mode switch 82 is shifted to its "OFF" position, the massaging elements are immediately caused to stop and, when the switch 82 is shifted to its "RESET" position (RST), the elements are always reset to, preferably, the point X0 where their spacing and projection are the minimum and shifted up to the point Y0 where they are at the highest position. In other words, in the massager according to the present invention, the mode switch 82 is to be shifted to the "RESET" position upon termination of the massaging operation so that the massaging elements are caused to be located always at the predetermined position for the initiation of the next massaging operation. Accordingly, the next massaging operation can be reliably prevented from being started at any random and undesired position of the massaging elements, and can be started from the position set by the user for the set range of the operation, taking most desirably into account the blood circulation path.

It will be readily understood by those skilled in the art that the various operations of the massaging elements carried out by the actuation of such various switches as above can be controlled by the microcomputer forming specifically the main control circuit 81.

Figure 10:
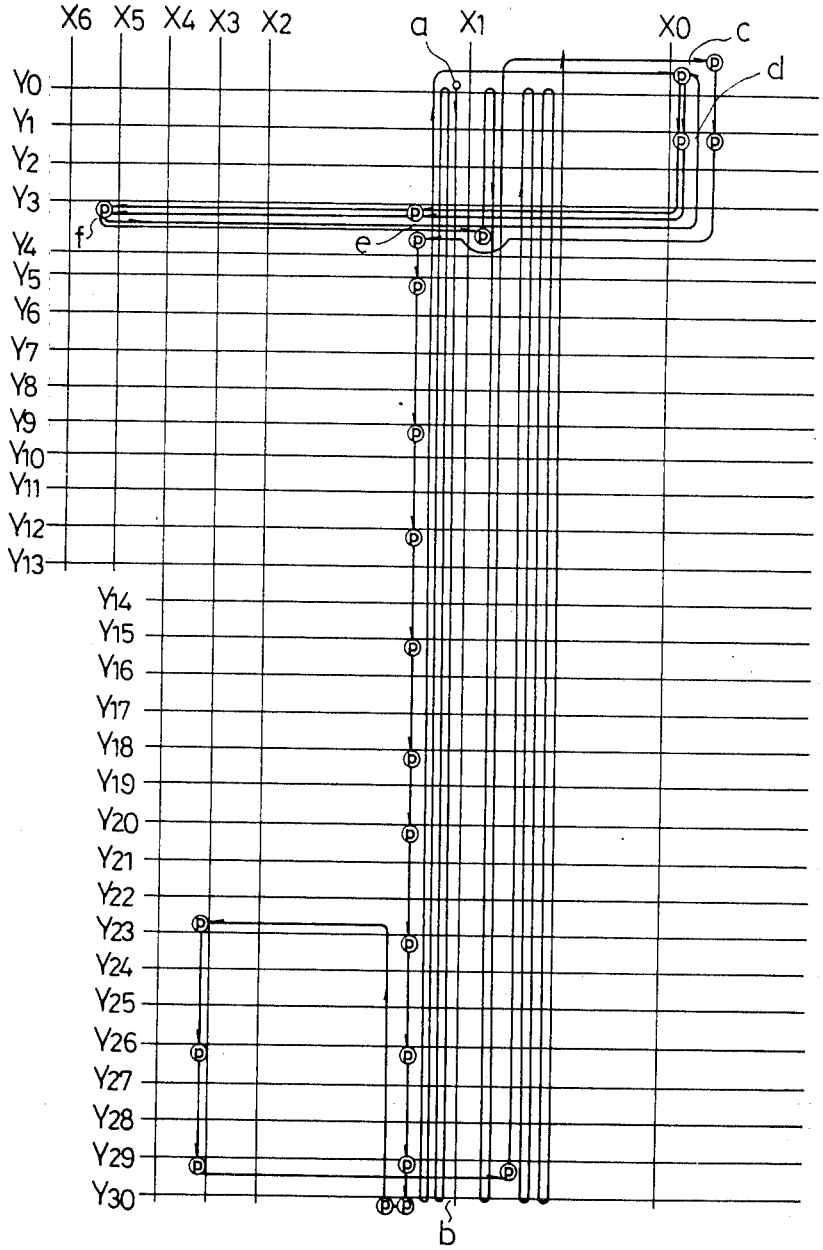
FIGS. 10 to 12 are diagrams for explaining massaging operations in different three modes executed by massaging elements in accordance with operational program patterns in the main control circuit of FIG. 8, the modes being shown with shifting loci of the massaging elements.

Further according to the massager of the present invention, the massaging operation can be effected in accordance with one of the predetermined program patterns programmed preliminarily in the microcomputer of the main control circuit. Now, provided that the user having generally the largest sitting height sets the height setting switch 83 at its extreme position "7" and the pattern select switch 84 at its "WHOLE" position, the start switch 85 thereafter actuated will cause the massaging elements to automatically shift along such a locus as shown in FIG. 10 as being controlled by the main control circuit 81. More specifically, as the massaging elements have been returned at the end of the previous massaging operation to the position of, for example, the highest point Y0 at the minimum spacing point X0 and with the minimum projection, the massaging elements will shift initially to a position "a" of the points X1 and Y0 and expand to the largest projected position. Next, the massaging elements will vertically reciprocate twice between the position "a" and the lowermost position "b" of the points X1 and Y30 while providing a relatively light rubbing type massaging operation similar to the foregoing back stretching operation and will be thereafter returned to the original position "c" of the points X0, Y0 for providing a relatively strong pressing massage-up operation to a body part closest to the user's neck. The massaging elements are then caused to shift to a position "d" of the points X0, Y1 for providing a massage-up operation to the neck part and further shift sequentially to a position "e" of the points X1, X3 and to a position "f" of the points X5, Y3 for the massage-down operation at the inner side and outer side parts of the user's shoulders.

After the operation at the position "f", the same massage up and down operations as above are repeatedly performed at the positions "c", "d", "e" and "f", and the massaging elements will perform the rubbing massage operation along a vertical path of the points X1, Y3; X1, Y0; X1, Y30 and X1, Y0 and then go to the positions "c" and "d" where the massage-up operation is again performed and to the position "e" for the massage-down operation. Next, the massaging elements shift down from the position "e" to the position "b" while performing sequentially the massage-up operation at every position denoted by encircled "p", the elements will then shift up and expand to a position of points X3, Y23 and down to a position of points X3, Y29 while providing the massage-up operation at each of the encircled "p" positions until they reach the position "b" where the massage-up operation is performed. Further, the massaging elements will vertically reciprocate twice between the positions "b" and "a" providing a finishing rubbing massage and return up to the position "a" to complete the "WHOLE" massage program pattern. In this connection, it will be appreciated that respective numbers of the reciprocation with the rubbing massage between the positions "a" and "b", positions where the pressing massage up and down operations are performed, and revolution of the massaging elements upon the pressing massage can be properly increased or decreased, and that these numbers can be controlled by the counter circuit shown in FIG. 8 or the like.

Figure 11:
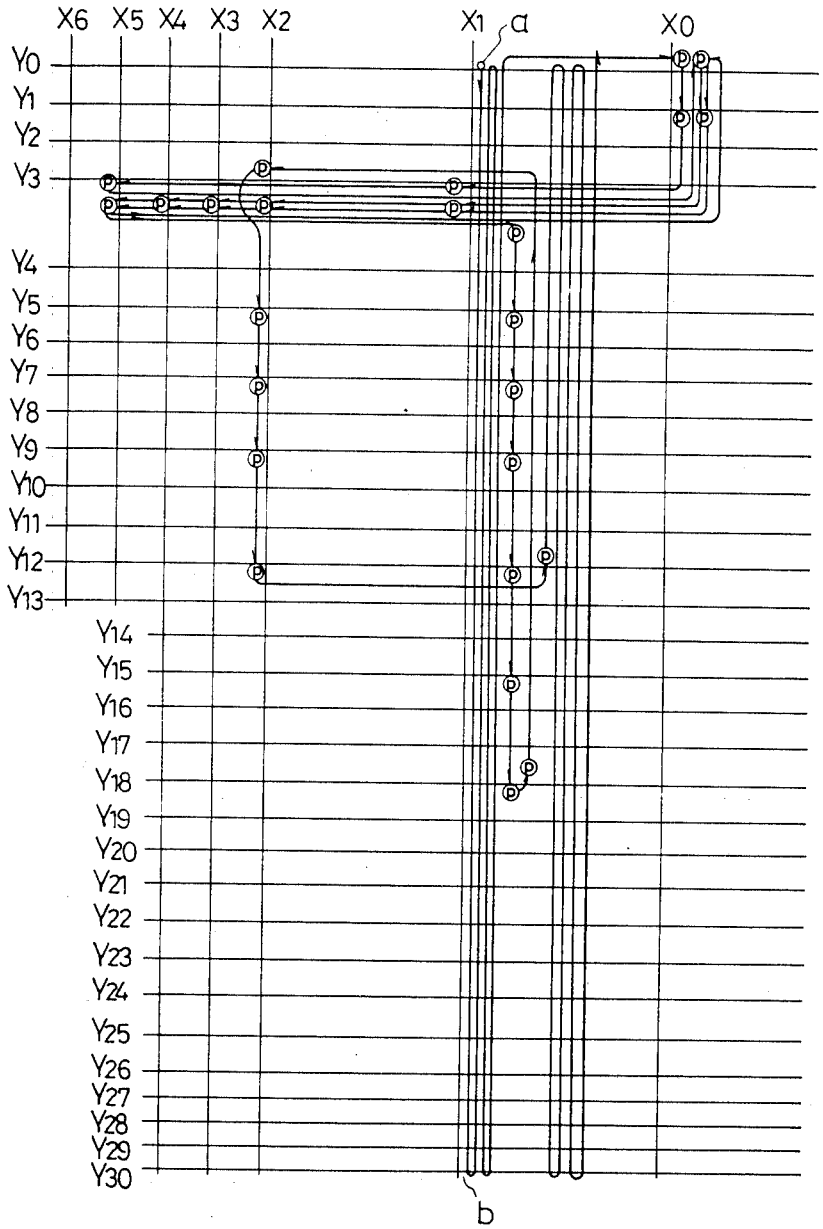

FIG. 11 shows a locus of the massaging elements when the pattern switch 84 is shifted to the "NECK,-SHOULDER" position. The massaging elements which are initially located at the position "a" as in the case of FIG. 10 will shift in the direction of respective arrows given in the locus, in which the elements will provide the rubbing massages between the positions "a" and "b" just after the start and before the termination of the "NECK,SHOULDER" pattern which also includes the pressing massage up and down operations sequentially performed at the respective encircled "p" positions during each of the rubbing massages twice performed. Therefore, as will be clear from the drawing, the relatively stronger pressing massages are applied concentratively to the upper portion of the user's back.

Figure 12:
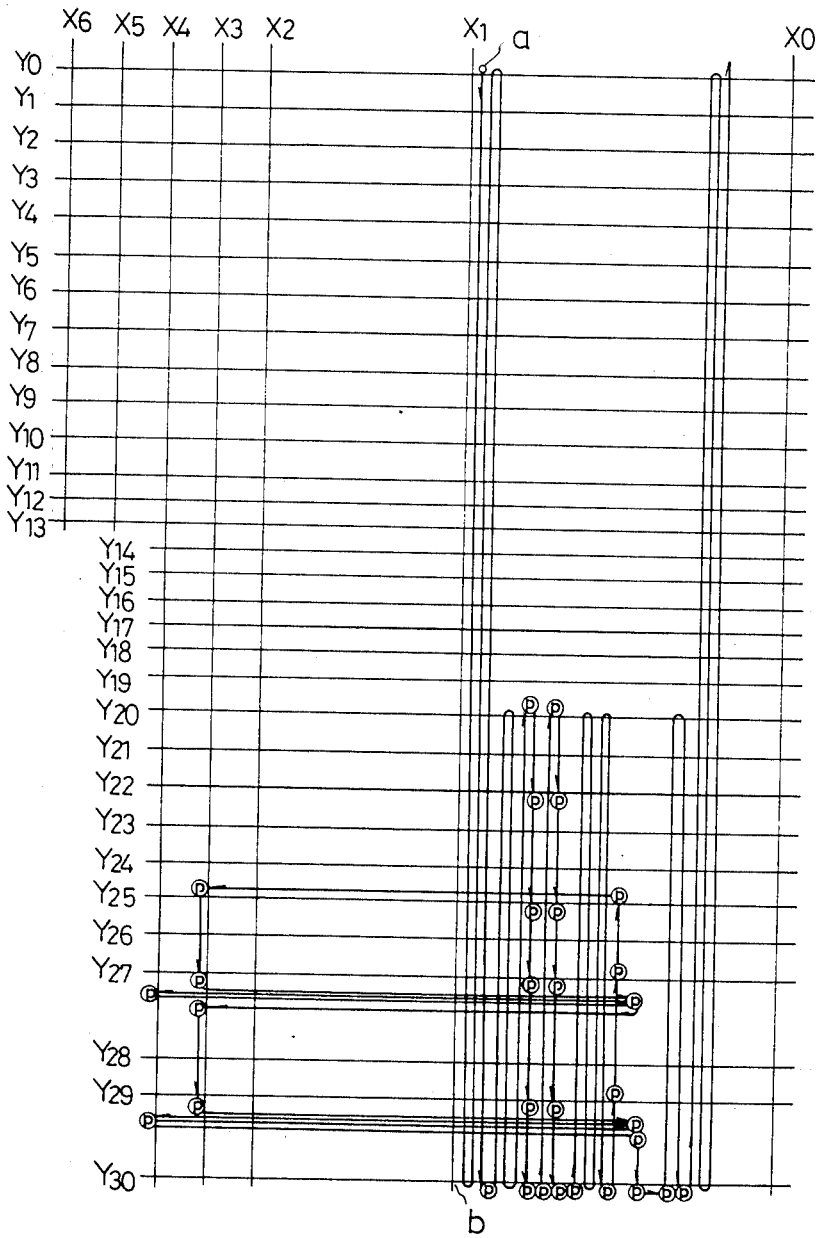

FIG. 12 shows a locus of the massaging elements performed when the pattern switch 84 is shifted to the "WAIST" position, in which event the massaging elements initially located at the position "a" will shift vertically in the direction of arrows given to the locus while providing the relatively light rubbing massages during the reciprocations between the positions "a" and "b" performed immediately after the start and before the termination of the "WAIST" pattern which specifically involves the relatively stronger pressing massage up and down operations sequentially performed at the encircled "p" positions concentratively distributed to the lower portion of the user's back between the twice performed light rubbing massages.

It will be readily appreciated that, while in the embodiment described above the driving shaft has been shown as passed through the main shaft, the driving shaft may be arranged in any other manner so long as it is capable of shifting the entire massager in directions perpendicular to the axis of the massager, e.g., even as separated from the main shaft.

According to the present invention arranged as above, specifically the massaging elements are made to be selectively shiftable and rotatable and to be operatively sufficiently controllable by the control means, and the operations of the elements can be started always from the predetermined position, whereby a highly effective massaging can be realized.

What is claimed as our invention is:

1. A massager comprising:

a supporting frame, a reversible rotary driving source supported by said supporting frame, a shaft means including a main shaft and a driving shaft, said main and driving shafts rotatably supported by the supporting frame for independent rotation, a pair of massaging wheels mounted eccentrically and symmetrically slanted on said main shaft to be rotatable with said main shaft and shiftable relative to each other in the axial direction of said main shaft, first drive transmitting means for transmitting rotary drive power from said driving source to said main shaft to rotate said main shaft and said eccentric massaging wheels such that said wheels move toward a user's body to a proximate position, and away from a user's body to a remote position, spacing-varying means connected with said first drive transmitting means and said massaging wheels for varying the spacing between said massaging wheels by shifting them relative to each other on said main shaft between minimum and maximum spacing positions, during rotation of said main shaft, displacement means coupled to end portions of said driving shaft for displacing said shaft means perpendicularly to the longitudinal axes of said main and driving shafts between two extreme positions, in response to rotation of said driving shaft, second drive transmitting means for transmitting rotary drive power from said driving source to said driving shaft for effecting said displacement of said shaft means, control means for controlling the positions of said shaft means and said massaging wheels, comprising:

first detecting means for detecting the spacing of said massaging wheels between said minimum and maximum spacing positions, second detecting means for detecting the position of said shaft means between said two extreme positions, third detecting means for detecting the position of said massaging wheels between said remote and proximate positions, means connected to said first detecting means and said first drive transmitting means for actuating the latter in response to a termination of a massaging operation for moving said massaging wheels to said remote position, means connected to said second detecting means and said second drive transmitting means for actuating the latter in response to a termination of a massaging operation for displacing said shaft means to one of said extreme positions, means connected to said third detecting means for said spacing-varying means for actuating the latter in response to a termination of a massaging operation for shifting said massaging wheels to said minimum spacing position, and means connected to said first detecting means and said first drive transmitting means for actuating the latter in response to an initiation of a massaging operation for moving said massaging wheels to said proximate position.

2. A massager according to claim 1 including means for limiting the upper extent of an upper one of said extreme positions of movement of said shaft means in order to adapt the upper limit of said massaging wheels to the height of a user.

3. A massager according to claim 2, wherein said control means comprises means connected to said second drive transmitting means for moving said shaft means to a lower one of said extreme positions upon initiation of a massaging operation, and means connected to said first drive transmitting means for moving said massaging wheels to said proximate position during such movement of said shaft means to said lower extreme position.

* * * * *